United States Patent [19]

Fecker et al.

[11] 4,028,911

[45] June 14, 1977

[54] INCLINED PIN WHEEL FOR YARN STORAGE DRUM

[75] Inventors: Josef Fecker, Steinhofen-Bisingen; Gustav Memminger, Freudenstadt, both of Germany

[73] Assignee: Firma Gustav Memminger Verfahrenstechnik fuer die Maschenindustrie, Freudenstadt, Germany

[22] Filed: Dec. 19, 1975

[21] Appl. No.: 642,655

[30] Foreign Application Priority Data

Dec. 28, 1974 Germany ..... 2461746

[52] U.S. Cl. ..... 66/132 R; 242/47.01; 242/47.12

[51] Int. Cl.[2] ..... D04B 15/48; B65H 51/20

[58] Field of Search ..... 66/132 R; 242/47.01, 242/47.12

[56] References Cited

UNITED STATES PATENTS

| | | | |
|---|---|---|---|
| 3,606,975 | 9/1971 | Rosen | 242/47.12 |
| 3,703,090 | 10/1972 | Rosen | 66/132 R |
| 3,713,307 | 1/1973 | Muhlhausler | 242/47.12 |
| 3,791,598 | 1/1974 | Vischiani et al. | 242/47.12 |
| 3,904,141 | 9/1975 | Rosen | 242/47.12 |
| 3,921,925 | 11/1975 | Sarfati et al. | 242/47.01 |
| 3,924,818 | 12/1975 | Pfeifle | 242/47.12 X |
| 3,994,446 | 11/1976 | Jacobsson | 66/132 R X |

*Primary Examiner*—Louis K. Rimrodt
*Assistant Examiner*—A. M. Falik
*Attorney, Agent, or Firm*—Flynn & Frishauf

[57] ABSTRACT

To maintain the windings or wraps of yarn on a supply drum formed of spaced rods, corrugations or the like, in a predetermined axial region thereof and to move the yarn axially along the drum, a pin-wheel gear or stub-tooth gear is arranged laterally of the drum, with the pins or stub teeth at an angle with respect to the axis of rotation of the drum, the pins or stubs being moved by engagement with the rods or corrugations of the drum as the drum rotates when driven to store yarn, the inclination of the pin-wheel gear providing an axially directed pushing force against the windings accumulating on the drum.

7 Claims, 1 Drawing Figure

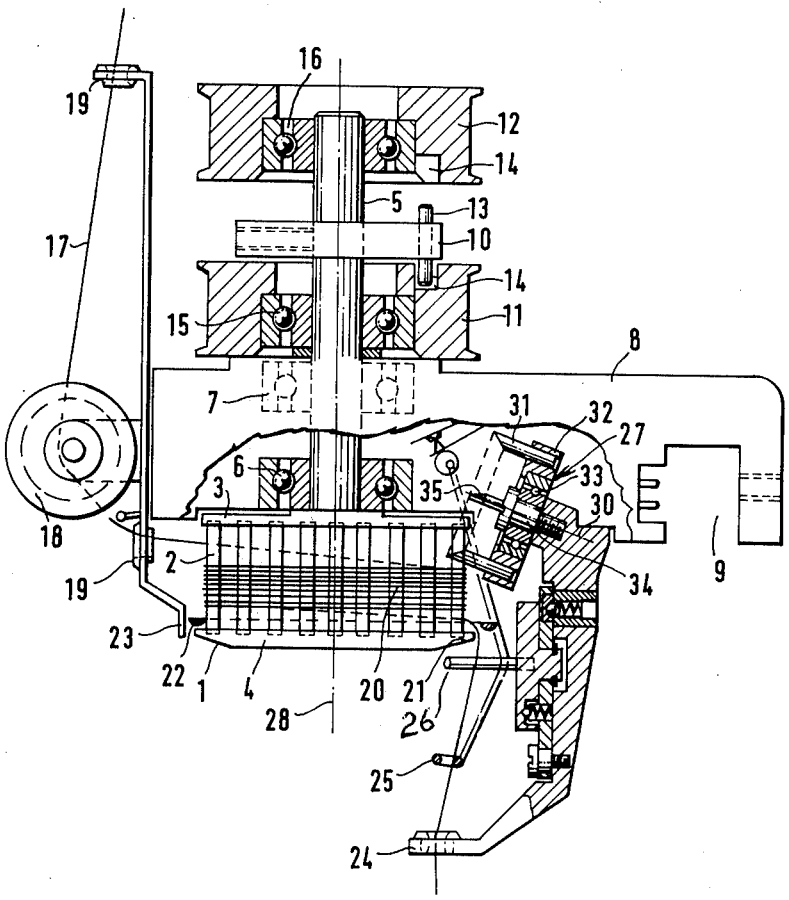
16
19
12
14
5
13
17
10
14
15
11
8
7
31
32
27
6
33
3
35
30
18
2
34
9
19
23
22
1
4
20
21
28
26
25
24

INCLINED PIN WHEEL FOR YARN STORAGE DRUM

The cross references to related applications showing yarn delivery apparatus are U.S. Ser. No. 642,257, filed Dec. 19, 1975, FECKER et al. and U.S. Ser. No. 642,605, filed Dec. 19, 1975, FECKER et al. both assigned to the assignee of the present application.

The present invention relates to a yarn delivery apparatus for textile machinery and more particularly to a yarn delivery apparatus in which yarn is stored on a storage drum which is rotatable and pulled off the head or axial end of the drum for supply to a textile machine, more particularly to a circular knitting machine.

Various types of yarn delivery apparatus have been proposed, and one apparatus of the type to which the invention relates is shown in German Publication Paper DT-AS No. 2,160,161. This application describes the use of a storage drum on which a reserve of yarn is accumulated in the form of a series of windings or wraps around the drum. This type of apparatus permits compact arrangement of the machine and obviates the long paths of yarn between a supply cone to the actual knitting feeds which was previously needed in order to obtain the necessary reserve of readily available, tensioned yarn when yarn was supplied to textile machines, particularly to knitting machines. The wraps or windings of the yarn which form the supply or storage windings are frictionally retained on the storage drum. Due to this frictional engagement of the yarn with the drum, irregularities in windings of the yarn on the supply cone which might interfere with uniform use of the yarn, for example by the knitting needles, are effectively avoided and yarn can be supplied under uniform tension from the storage drum to the knitting feed, or other utilization point. The yarn drawn off the storage drum is characterized by having accurately uniform tension, so that the fabric knitted with such yarn will have uniform, first-grade quality.

The storage drum is usually driven in dependence on the axial length of the supply windings thereon. Various types of sensing and feeler mechanisms are provided in order to sense the axial length of the supply windings to determine predetermined maximum and minimum axial lengths of the supply windings. These devices may, for example, be lightly loaded feelers which engage the upper winding and operate microswitches upon deflection of the feeler arm through a predetermined range to either connector or disconnect the storage drum from a supply.

The yarn is usually drawn off the storage drum over the head from below and the new yarn is supplied thereto at the upper region. The yarn which is drawn off axially is replaced by windings at the upper region of the storage drum. It is thus necessary to move the windings which are wound on the drum in axial direction; this movement should preferably be continuous, in downward direction. It has previously been proposed to utilize a feed element in the form of a wobble disk — see German Publication Paper DT-AS No. 2,160,161. The wobble disk is inclined and is formed with fingers which project radially between axial rods of a cage-shaped drum, the rods engaging the uppermost one of the windings of the supply on the drum. A similar feed mechanism is disclosed in German Disclosure Document DT-OS No. 2,228,754.

Disks which engage the yarn, for example of the type formed with fingers extending between the rods of a cage and which operate in form of a wobble disk, require bearing structures in the interior of the drum. These bearing structures are of comparatively large size. Assembly and disassembly are complicated since all operations must be carried out within the cage formed by the drum.

It is an object of the present invention to provide a yarn delivery apparatus in which the axial feed of the yarn is a simple mechanism and which, further, is so arranged that the feed is independent of the direction of rotation of the drum, which is not the case with many thread supply devices in commercial installations, which must be constructed for specific directions of rotation.

SUBJECT MATTER OF THE PRESENT INVENTION

Briefly, the feed element is a gear in form of a pin-wheel gear or stub-tooth gear which has projecting pins or teeth which engage projecting rods or corrugations of a cage-shaped drum. The pin-wheel or stub-tooth gear is freely rotatable about a shaft having an axis which is inclined with respect to the axis of rotation of the supply drum. The windings of the yarn to be fed are located beneath the projecting pins or teeth of the gear at the circumference of the drum.

The angle of inclination of the axis of the pin-wheel gear preferably forms an acute angle with the axis of rotation of the drum. The uppermost winding of the yarn on the drum is thus pressed by the pins of the pin-wheel gear radially against the bars or corrugations of the drum, thus preventing that the yarn can run over a previously wound winding if the supply tension is low. In a preferred form, the pin-wheel gear is located essentially opposite the side of the drum to which the thread is being supplied. The axis of rotation of the pin-wheel gear and of the supply drum are preferably in a single plane.

The pin-wheel gear of stub-tooth gear forming the feed arrangement in accordance with the present invention is easy to assemble with the drum and easy to manufacture; maintenance is simple. The direction of rotation of the drum is irrelevant with respect to the feed arrangement, so that the yarn supply apparatus can be universally used for either clockwise or counterclockwise rotation, without making any changes in the apparatus.

The invention will be described by way of example with reference to the accompanying drawing, wherein the single FIGURE illustrates a thread delivery apparatus in accordance with the present invention in part longitudinal axial section and part side view thereof.

The yarn delivery apparatus essentially has a drum 1 formed as a cage, having axially extending rods 2 which are held in end disks 3, 4. The rods 2 are located on the circumference of an imaginary cylinder. Drum 1 depends from a vertically mounted drive shaft 5 which is journalled by ball bearings 6, 7 in a holder or support 8. The support 8 can be attached by means of suitable clamping arrangements to a holding ring of a textile machine, for example to the holding of a circular knitting machine, as well known in the art. A coupling element 10 is fixed to the shaft 5 to rotate therewith. Coupling element 10 can be selectively engaged with a pulley 11 or a pulley 12; the pulleys 11 and 12 may have different diameters. The coupling element 10 has a pin or tooth 13 which engages a matching hole 14 in the respective pulley 11, or 12. The pulleys 11, 12 are journalled by bearings 15, 16 on the drive shaft 5 to be freely rotatable with respect thereto. They are driven by flat belts (not shown) which in turn are driven by a suitable drive motor (not shown); the belts engaging the respective pulleys 11, 12 may be driven at different speeds. Other drive arrangements may be used, such as V-belts, sprocket chains, sprocket belts, or individual motors.

A yarn or thread 17 is supplied to the drum 1, guided through a supply eye 19 and led over a thread brake to a second guide eye 19'. The yarn 17 is then wound on the drum upon rotation thereof. It is tangentially applied thereto. A yarn storage winding 20, formed of a plurality of wraps or loops, will accumulate about the drum. The axial length of the storage winding 20 will vary between a maximum and a minimum. The yarn is then pulled off the head end of the drum over an edge flange 21 and supplied to the working position on a suitable textile machine, for example to a feed of a knitting machine. The yarn 17 runs through the gap formed by a braking ring 22 and the edge 21. Ring 22 has a slightly greater diameter than the diameter of drum 1 and seats loosely thereon. The position of the ring 22 is determined by a fixed stop 23 radially engaging the ring 22 and located, for example, at the same side as the thread guiding eye 19'. The yarn 17 being removed from the head end is further guided through a thread guiding eye 24. The tension of the yarn is supervised by a yarn breakage sensor 25 which is combined with a stop-motion device. The position at which the yarn is taken off from the drum may be at random or may be fixedly determined by a pin 26 if positive yarn supply is desired.

A coupling or stop or braking mechanism can be located within the hollow portion of the drum 1. Many such mechanisms are known, and a suitable one is described, for example, in German Disclosure Document DT-OS No. 1,928,040.

The drum need not be formed by spaced rods 2, but may be formed as a solid body with a corrugated or undulating outer surface. As used herein, the term "corrugated surface" will therefore be applicable both to a solid drum with an undulting surface and to a drum in which the outer surface is defined by separate pins or rods located along the circumference of the cylinder.

A feed mechanism engages the upper wrap or loop of the supply windings 20. This feed mechanism, in accordance with the present invention, is formed as a pin-wheel gear or stub-tooth wheel or gear 27, freely rotatable about an axis 30. The axis 30 and the axis of rotation 28 of the drum 1 are in a single plane, and the axis 30 is inclined with respect to the axis 28 so that an acute angle is formed therebetween in which the upper wrap or loop of the storage windings 20 is included.

The pin-wheel gear 37 is formed by a disk 32 from which teeth 31 project, secured adjacent the circumference of the disk 32 in circular arrangement. The disk 32 is journalled by bearing 33 on shaft 34, which defines the axis 30 of rotation of the gear 27. The teeth 31 are inwardly inclined, as best seen in the upper and lower teeth 31 in the FIGURE. The teeth 31 engage in the space between the projections of the corrugated surface forming the drum 1, that is, between the pins or rods 2 when the drum 1 is formed as a cage, or between the outer undulations if the drum 1 is formed as an essentially solid body. Upon rotation of drum 1, the wheel 27 is carried along by engagement of the teeth 31 with the outer portions of the corrugations thereof.

The FIGURE clearly shows that the gear or wheel 27 is located at the side of the drum opposite that where the thread 17 is supplied. The thread 17 guided by the lower thread guide eye 19' is tangentially applied to the drum and will thus always fall beneath the teeth 31, so that, upon rotation of the wheel 27 due to rotation of drum 1, the uppermost loop of the storage winding 20 will be pushed downwardly so that the entire storage windings 20 will be continuously moved downwardly in axial direction.

Operation, with intermittent yarn supply: If the storage windings 20 have not reached their maximum axial length, then drum 1 rotates, driven by the one or the other of the pulleys 11, 12 in engagement with the drive wheel 10. Upon rotation of drum 1, yarn is constantly supplied to the drum and wound thereon. The teeth 31 engaging the outer surfaces of the corrugations of drum 1 will spin gear 27 and thus continuously push the storage windings 20 axially downwardly. Since the axis 30 of the wheel 27 and the axis 28 of drum 1 include an acute angle, the yarn of the uppermost wrap or loop of the storage windings 20 is pushed radially inwardly towards the outer surfaces of the corrugations (for example pins 2) of the drum 1, so that even if the thread brake 18 is set for extremely low tension, piling of threads above each other is reliably avoided.

When the storage windings 20 have reached a predetermined maximum axial length, the shut-off mechanism (not shown herein) becomes effective, and drum 1 is disconnected from its drive source; if the drum has an individual motor, it is stopped directly. Drum 1 will, therefore, stop. The yarn supplied to the working position will continue to be removed, however, being pulled off the head of the drum 1. When the storage windings 20 then have reached a predetermined minimum length, the shut-off mechanism is again operated and drum 1 is again connected to its drive source, or the individual drive motor started, again filling the drum 1 with the storage windings 20 up to its maximum axial length.

If the drum 1 is a solid drum, the outer surface may either be corrugated or formed with axially extending slits or grooves to permit engagement of the teeth 31 of the wheel 27 therewith.

The wheel 27 may also be located within the drum 1, engaging with its teeth 31 through the gaps between the pins 2, or interiorly of corrugations. Wheel 27 can also be shaped differently; it need not be a pin-wheel gear or a stub-tooth gear, as shown, but may be formed of a hub with radially projecting teeth. A spur pinion can also be used.

The operation, as described, would be applied if pin 26 is either removed or placed in an ineffective position, as disclosed and described in detail in co-pending application Ser. No. 642,257, filed Dec. 19, 1975 by FECKER et al. In this operating condition, the pull-off position of the yarn from the drum occurs at random.

If pin 26 is in the position shown in the FIGURE, the pull-off position of the yarn is fixed in space with respect to the circumference of the drum. This is referred to as positive yarn supply, since the drum 1 can supply only as much yarn as is being wound thereon. For such operation, drum 1 is constantly driven. The shut-off mechanism responding to the axial length of the storage windings 20 then is not needed, or can be disabled. Rotation of the drum 1 renders yarn supply more uniform, however, than if the yarn were pulled off directly from a wound cone.

Various changes and modifications may be made within the scope of the inventive concept.

We claim:

1. Yarn delivery apparatus for textile machines such as a knitting machine having a support (8), a rotatable storage drum (1) journalled on the support to rotate about a driven axis (28) and formed with a corrugated surface for winding thereon a yarn (17) in a plurality of windings to form yarn storage windings (20) upon rotation of the drum, and permitting pull-off of the yarn over an axial end thereof, means (5) rotating said drum, and means axially moving the storage windings comprising;

a pin-wheel or stub-tooth gear (27) to feed the windings of the yarn about the drum axially thereof, the pin-wheel or stub-tooth gear having projecting pins or teeth (31) extending towards the drum, said wheel or gear having a fixed axis of rotation, and bearing means (33) freely journalling said pin wheel or stub tooth gear (27) on the support (8) with the axis of rotation (30) thereof being inclined with respect to the axis of rotation (28) of the drum (1) and with the projecting pins or teeth (31) thereof engaging the corrugations of the drum (1)

to provide for free rotation of said pinwheel or stub tooth gear (27) upon engagement with the corrugated surface of the storage drum (1), the yarn being supplied to the drum (1) beneath the pins or teeth (31) of the pin wheel or stub tooth gear (27).

2. Apparatus according to claim 1, wherein the pinwheel or stub-tooth gear (27) is located outside of the circumference of the drum (1) and adjacent thereto.

3. Apparatus according to claim 1, wherein the pinwheel or stub-tooth gear (27) comprises a rotatable disk (32) and pins or teeth (31) projecting from the disk.

4. Apparatus according to claim 1, wherein the pins or teeth (31) have inclined free ends.

5. Apparatus according to claim 1, wherein the angle of inclination between the axis (30) of the wheel or gear (27) and the axis (28) of the drum (1) is inclined towards the yarn supply (20) and forms an acute angle therewith, the uppermost wrap or winding of the storage windings (20) being located or included within said angle.

6. Apparatus according to claim 1, further comprising thread guide means (19, 18, 19') guiding yarn for winding on the drum (1);

and wherein the wheel or gear (27) is located essentially diametrically opposite of the drum (1) with respect to said guide means.

7. Apparatus according to claim 1, wherein the axis of rotation (28) of the drum (1) and the axis of rotation (30) of the wheel or gear (27) are located in a common plane.

* * * * *